US011215042B2

(12) United States Patent
Wai et al.

(10) Patent No.: US 11,215,042 B2
(45) Date of Patent: Jan. 4, 2022

(54) DOWNHOLE SHOCK SENSOR

(71) Applicant: Halliburton Energy Services, Inc., Houston, TX (US)

(72) Inventors: Simon Whye Kwong Wai, Singapore (SG); Kuo Hwi Roy Tan, Singapore (SG); Nikhil Manmadhan Kartha, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 134 days.

(21) Appl. No.: 16/618,695

(22) PCT Filed: Dec. 28, 2018

(86) PCT No.: PCT/US2018/067824
§ 371 (c)(1),
(2) Date: Dec. 2, 2019

(87) PCT Pub. No.: WO2020/139366
PCT Pub. Date: Jul. 2, 2020

(65) Prior Publication Data

US 2021/0079768 A1 Mar. 18, 2021

(51) Int. Cl.

| | |
|---|---|
| ***E21B 43/119*** | (2006.01) |
| ***E21B 47/092*** | (2012.01) |
| ***E21B 43/1185*** | (2006.01) |

(52) U.S. Cl.
CPC ..... *E21B 43/119* (2013.01); *E21B 43/11857* (2013.01); *E21B 47/092* (2020.05)

(58) Field of Classification Search
CPC ..... E21B 43/119; E21B 43/1193; E21B 43/11857; E21B 43/11; E21B 47/00; E21B 19/22; G01L 5/00
See application file for complete search history.

(56) References Cited

U.S. PATENT DOCUMENTS

| | | | | |
|---|---|---|---|---|
| 4,843,877 A * | 7/1989 | Kushida | G01P 15/11 73/514.08 |
| 5,024,087 A | 6/1991 | Nagasaki et al. | |
| 5,233,872 A * | 8/1993 | Kushida | G01P 15/11 73/497 |
| 5,741,970 A | 4/1998 | Rubin | |

(Continued)

FOREIGN PATENT DOCUMENTS

EP 0438815 9/1993

OTHER PUBLICATIONS

ISRWO International Search Report and Written Opinion for PCT/US2018/067824 dated Sep. 25, 2019.

*Primary Examiner* — Kristyn A Hall
(74) *Attorney, Agent, or Firm* — John Wustenberg; C. Tumey Law Group PLLC

(57) ABSTRACT

A shock sensor, comprising: a housing, wherein the housing is cylindrical, wherein the housing comprises: a first end; a second end; a central bore that traverses a length of the housing; and an internal cavity; a coil, wherein the coil is disposed about the central bore; at least two magnets, wherein the at least two magnets are disposed about the central bore; a spring, wherein the spring is a compression spring, wherein the spring is disposed within the housing, wherein the spring comprises a first end and a second end; and a metallic member, wherein the metallic member is disposed at the second end of the spring.

20 Claims, 4 Drawing Sheets

(56) References Cited

U.S. PATENT DOCUMENTS

| | | | |
|---|---|---|---|
| 7,165,612 | B2 | 1/2007 | McLaughlin |
| 8,985,200 | B2 | 3/2015 | Rodgers et al. |
| 9,631,446 | B2 | 4/2017 | Hradecky |
| 2007/0214889 | A1 | 9/2007 | Pristup |
| 2016/0047235 | A1 | 2/2016 | Bondarenko et al. |
| 2018/0320461 | A1 | 11/2018 | Wisinger, Jr. et al. |

* cited by examiner

DOWNHOLE SHOCK SENSOR

BACKGROUND

Wells may be drilled at various depths to access and produce oil, gas, minerals, and other naturally-occurring deposits from subterranean geological formations. A completed well may be perforated in order to provide communication between the well and the subterranean geological formation.

Attempts have been made to determine the effects of shock due to perforating on other components of a perforating string. It may be desirable, for example, to prevent unsetting a production packer, to prevent failure of a perforating gun body, and to otherwise prevent or at least reduce damage to the various components of a perforating string. Unfortunately, past attempts have not satisfactorily measured the strains, pressures, and/or accelerations, etc., produced by perforating. This may make estimations of conditions to be experienced by current and future perforating string designs unreliable. Further, efficiency may be lost as there currently is not a real-time feedback of whether or not perforation has occurred downhole.

BRIEF DESCRIPTION OF THE DRAWINGS

These drawings illustrate certain aspects of some examples of the present disclosure, and should not be used to limit or define the disclosure.

DETAILED DESCRIPTION

The present disclosure relates generally to sensing shock generated by a perforating system and, more particularly, to a sensor used for real-time feedback to sense the perforation shock. The sensor may use simple, robust electromechanical components without requiring additional downhole circuitry. In examples, the sensor may use a coil and magnet assembly with a magnetic member that moves in relation to each other based on the shock produced by the perforating system.

Figure 1:
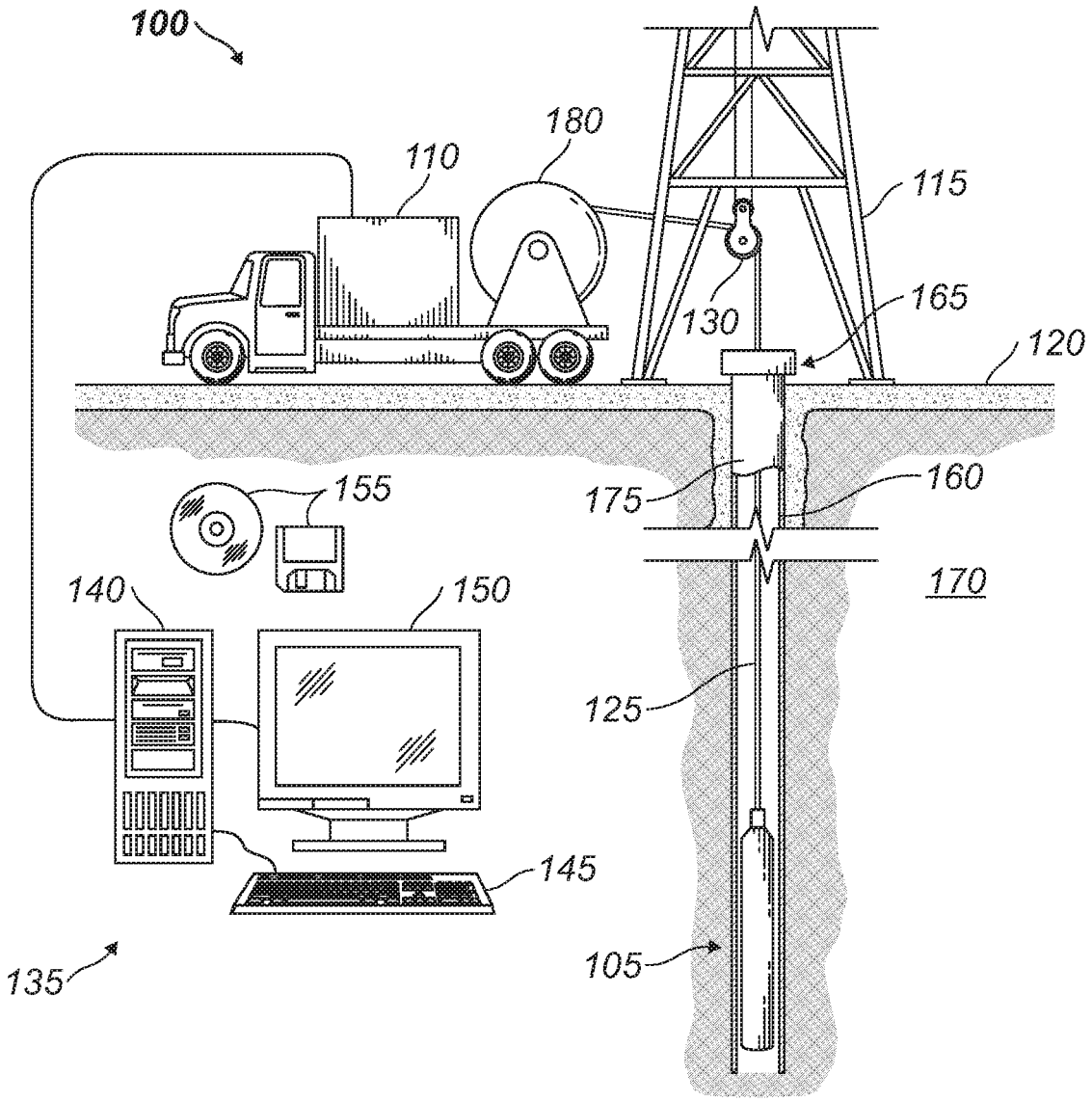
FIG. 1 illustrate an example of a well system.

FIG. 1 illustrates a cross-sectional view of a well system 100. As illustrated, well system 100 may include a shock sensor 105 attached to a vehicle 110. In examples, it should be noted that shock sensor 105 may not be attached to a vehicle 110 but may be attached to any other suitable object. Shock sensor 105 may be supported by a rig 115 at a surface 120. Shock sensor 105 may be tethered to vehicle 110 through a conveyance 125. Conveyance 125 may be disposed around one or more sheave wheels 130 located on vehicle 110. During operations, the one or more sheave wheels 130 may rotate to lower and/or raise conveyance 125 downhole. As shock sensor 105 is coupled to conveyance 125, shock sensor 105 may be displaced accordingly with conveyance 125. Conveyance 125 may include any suitable means for providing mechanical conveyance for shock sensor 105 including, but not limited to, wireline, slickline, coiled tubing, pipe, drill pipe, drill string, tubular string, downhole tractor, and/or the like. In some embodiments, conveyance 125 may provide mechanical suspension, as well as electrical connectivity, for sensor package 105. In examples, shock sensor 105 may be disposed about a downhole tool (i.e., a downhole perforating system) (not illustrated). Without limitations, the downhole tool may be any suitable downhole tool configured to perform a well completions operation and/or to obtain measurements while downhole. Information, such as measurements, from the downhole tool may be gathered and/or processed by an information handling system 135.

Systems and methods of the present disclosure may be implemented, at least in part, with information handling system 135. Without limitation, shock sensor 105 may be connected to and/or controlled by information handling system 135, which may be disposed on surface 120. Information handling system 135 may include band-selective filters, gain stages, digitizers, and/or combinations thereof. Information handling system 135 may be capable of processing an analog and/or digital signal. Information handling system 135 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, information handling system 135 may include a processing unit 140, a network storage device, or any other suitable device and may vary in size, shape, performance, functionality, and price. Information handling system 135 may include random access memory (RAM), one or more processing resources such as a central processing unit (CPU) or hardware or software control logic, ROM, and/or other types of nonvolatile memory. Additional components of the information handling system 135 may include one or more disk drives, one or more network ports for communication with external devices as well as various input and output (I/O) devices, such as an input device 145 (e.g., keyboard, mouse, etc.) and a video display 150. Information handling system 135 may also include one or more buses operable to transmit communications between the various hardware components.

Alternatively, systems and methods of the present disclosure may be implemented, at least in part, with non-transitory computer-readable media 155. Non-transitory computer-readable media 155 may include any instrumentality or aggregation of instrumentalities that may retain data and/or instructions for a period of time. Non-transitory computer-readable media 155 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

In alternate examples, information handling system 135 may be disposed downhole on and/or in conveyance 125 as a downhole information handling system (not illustrated). Processing of information recorded may occur downhole and/or on surface 120. Processing occurring downhole may be transmitted to surface 120 to be recorded, observed, and/or further analyzed. Additionally, information recorded on downhole information handling system may be stored until conveyance 125 traverses back uphole. In examples, information handling system 135 may communicate with downhole information handling system through a communication line (not illustrated) disposed in (or on) conveyance 125. In examples, wireless communication may be used to transmit information back and forth between information handling system 135 and downhole information handling system. Information handling system 135 may transmit information to downhole information handling system and may receive, as well as process, information recorded by downhole information handling system.

In examples, downhole information handling system may include, without limitation, a microprocessor or other suitable circuitry, for estimating, receiving, and processing signals from shock sensor 105. Downhole information handling system may further include additional components, such as memory, input/output devices, interfaces, and the like. In examples, while not illustrated, downhole information handling system may include one or more additional components, such as analog-to-digital converter, filter and amplifier, among others, that may be used to process the measurements of shock sensor 105 before they may be transmitted to surface 120. Alternatively, raw measurements from shock sensor 105 may be transmitted to surface 120.

Any suitable technique may be used for transmitting signals from downhole information handling system to surface 120, including, but not limited to, wired pipe telemetry, mud-pulse telemetry, acoustic telemetry, and electromagnetic telemetry. While not illustrated, downhole information handling system may include a telemetry subassembly that may transmit telemetry data to surface 120. Without limitation, an electromagnetic source in the telemetry subassembly may be operable to generate pressure pulses in the drilling fluid that propagate along the fluid stream to surface 120. The data may then be analyzed and processed by information handling system 135.

As illustrated, shock sensor 105 may be disposed in a wellbore 160 by way of conveyance 125. Wellbore 160 may extend from a wellhead 165 into a subterranean formation 170 from surface 120. Wellbore 160 may be cased and/or uncased. In examples, wellbore 160 may include a metallic material, such as a tubular string 175. By way of example, tubular string 175 may be a casing, liner, tubing, or other elongated tubular disposed in wellbore 160. As illustrated, wellbore 160 may extend through subterranean formation 170. Wellbore 160 may generally extend vertically into the subterranean formation 170. However, wellbore 160 may extend at an angle through subterranean formation 170, such as horizontal and slanted wellbores. For example, although wellbore 160 is illustrated as a vertical or low inclination angle well, high inclination angle or horizontal placement of the well and equipment may be possible. It should further be noted that while wellbore 160 is generally depicted as a land-based operation, those skilled in the art may recognize that the principles described herein are equally applicable to subsea operations that employ floating or sea-based platforms and rigs, without departing from the scope of the disclosure.

In examples, rig 115 includes a load cell (not shown) which may determine the amount of pull on conveyance 125 at surface 120 of wellbore 160. While not shown, a safety valve may control the hydraulic pressure that drives a drum 180 on vehicle 110 which may reel up and/or release conveyance 125 which may move shock sensor 105 up and/or down wellbore 160. The safety valve may be adjusted to a pressure such that drum 180 may only impart a small amount of tension to conveyance 125 over and above the tension necessary to retrieve conveyance 125 and/or shock sensor 105 from wellbore 160. The safety valve may typically be set a few hundred pounds above the amount of desired safe pull on conveyance 125 such that once that limit is exceeded, further pull on conveyance 125 may be prevented.

Figure 2:
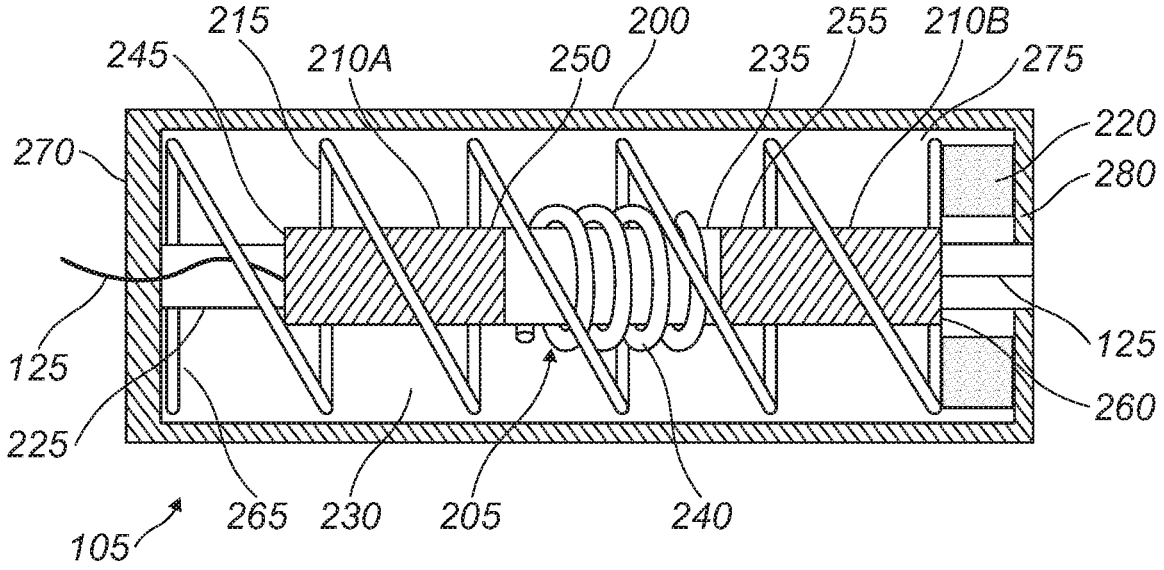
FIG. 2 illustrates an example of a shock sensor prior to a perforation.
Figure 3:
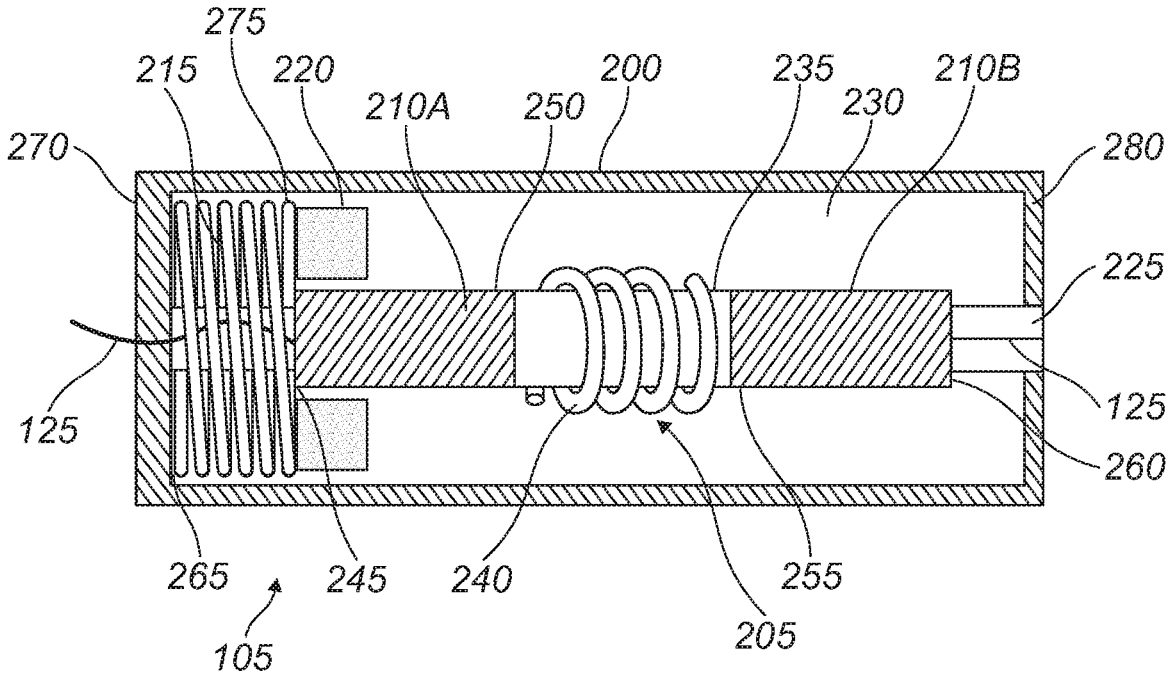
FIG. 3 illustrates an example of a shock sensor after perforation.

FIGS. 2-3 illustrate an example of shock sensor 105. FIG. 2 illustrates shock sensor 105 prior to a perforation operation. FIG. 3 illustrates shock sensor 105 after perforation has occurred. Shock sensor 105 may be configured to determine a perforation event by measuring a change in a magnetic field produced by the shock from the perforation event. Shock sensor 105 may include a housing 200, a coil 205, magnets 210A, 210B, a spring 215, and a metallic member 220. In examples, housing 200 of shock sensor 105 may be disposed on conveyance 125 and may displace as conveyance 125 moves accordingly. Housing 200 may be secured to conveyance 125 through the use of any suitable mechanisms, including, but not limited to, the use of suitable fasteners, threading, adhesives, welding, and/or combinations thereof. Without limitation, suitable fasteners may include nuts and bolts, washers, screws, pins, sockets, rods and studs, hinges and/or any combination thereof. Without limitation, housing 200 may include any suitable material such as metals, nonmetals, polymers, ceramics, and/or any combination thereof. Housing 200 may be any suitable size, height, and/or shape. Without limitation, a suitable shape may include, but is not limited to, cross-sectional shapes that are circular, elliptical, triangular, rectangular, square, hexagonal, and/or combinations thereof. In examples, housing 200 may have a circular cross-section with an inner diameter and an outer diameter to form a central bore 225 that traverses the length of housing 200. Housing 200 may further include an internal cavity 230 disposed between the inner diameter and the outer diameter of housing, wherein other components of shock sensor 105 may be disposed. As illustrated, conveyance 125 may be disposed within central bore 225 of housing 200 to connect to coil 205.

Coil 205 may be configured to produce a signal (i.e., a voltage) dependent on a change in a nearby magnetic field. Coil 205 may include a core 235 and wire 240. Core 235 may be disposed about central bore 225 within housing 200. Without limitations, core 235 may be disposed within, inside of, around, and/or on central bore 225. In examples, core 235 may be disposed so that a central axis of core 235 aligns with a central axis of housing 200. Core 235 may be any suitable size, height, and/or shape and may include any suitable material. In examples, core 235 may include magnetic material and may be a solid, cylindrical structure. Without limitations, core 235 may be a closed-core, open-core, or air-core. As illustrated, wire 240 may be disposed on core 235 and wrapped around core 235 in a spiral. Wire 240 may be any suitable wiring capable of being electrically conductive. In examples, wire 240 may be disposed in any suitable number of turns around core 235. During operations, as shock sensor 105 is actuated, coil 205 may measure a change in a nearby magnetic field produced by magnets 210A, 210B.

Magnets 210A, 210B may serve to produce a magnetic field about housing 200. There may be at least two magnets 210A, 210B within shock sensor 105. In other examples, there may be more than two magnets 210A, 210B. Magnets 210A, 210B may be disposed about central bore 225 within housing 200, wherein coil 205 is disposed between magnets 210A, 210B. Without limitations, magnets 210A, 210B may be disposed within, inside of, around, and/or on central bore 225. Each one of magnets 210A, 210B may abut coil 205.

In examples, magnets 210A, 210B may be disposed so that a central axis of magnets 210A, 210B aligns with a central axis of housing 200. Magnets 210A, 210B may be any suitable size, height, and/or shape and may include any suitable material capable to produce a magnetic field. Magnets 210A, 210B may be solid, cylindrical structures. There may be a central bore traversing the length of each of magnets 210A, 210B. Conveyance 125 may be disposed within the central bore of magnets 210A, 210B. In certain examples, magnet 210A may have similar or different dimensions to magnet 210B. In regards to the present example, magnet 210A may have a first end 245 and a second end 250, and magnet 210B may have a first end 255 and a second end 260. Second end 250 of magnet 210A may have the same polarity as first end 255 of magnet 210B.

As illustrated, spring 215 may be disposed around magnets 210A, 210B and central bore 225. In examples, spring 215 may be disposed so that a central axis of spring 215 aligns with a central axis of housing 200. Spring 215 may be any suitable size, height, and/or shape and may include any suitable elastic material. Without limitations, spring 215 may be a tension spring, compression spring, torsion spring, constant spring, variable spring, or a variable stiffness spring. In examples, spring 215 may be a compression spring. A first end 265 of spring 215 may be secured to a first end 270 of housing 200. First end 265 of spring 215 may be secured to first end 270 of housing 200 through the use of any suitable mechanisms, including, but not limited to, the use of suitable fasteners, threading, adhesives, welding, and/or combinations thereof. Without limitation, suitable fasteners may include nuts and bolts, washers, screws, pins, sockets, rods and studs, hinges and/or any combination thereof. A second end 275 of spring 215 may be disposed against metallic member 220, wherein second end 275 of spring 215 constrains metallic member 220 against a second end 280 of housing 200 when in a relaxed state. Spring 215 may be rigid enough to resist axial movement of metallic member 220.

Metallic member 220 may serve to be a moveable element within shock sensor 105. Metallic member 220 may be any suitable size, height, and/or shape and may include any suitable metal material that is magnetic. In examples, metallic member 220 may have a circular cross-section with an inner diameter and an outer diameter to form a ring. The inner diameter of metallic member 220 may be greater than magnets 210A, 210B and/or coil 205. Metallic member 220 may be disposed within internal cavity 230 of housing 200. In examples, metallic member 220 may be disposed so that a central axis of metallic member 220 aligns with a central axis of housing 200. As metallic member 220 is actuated, metallic member 220 may displace axially along housing 200 and compress spring 215.

During operations downhole, an operator may actuate a downhole perforating system (not illustrated), wherein shock sensor 105 may be disposed uphole in relation to the downhole perforating system. In examples, the operator may be defined as an individual, group of individuals, or an organization. As wellbore 160 (i.e., referring to FIG. 1) is perforated, a subsequent shock wave may be produced for each perforation. As the shock wave propagates uphole, the shock wave may include enough energy to displace metallic member 220 axially within housing 200, thereby compressing spring 215. As metallic member 220 displaces, there may be a change in the surrounding magnetic field. Coil 205 may generate an electrical signal (i.e., a voltage) that is correlated to the displacement of metallic member 220. As coil 205 is coupled to conveyance 125, the electrical signal may be transmitted uphole for processing at information handling system 135 (i.e., referring to FIG. 1). In alternate examples, the electrical signal may be processed downhole. After the shock wave actuates shock sensor 105, spring 215 may expand to displace metallic member 220 back to an initial position against second end 280 of housing 200. The present example may provide real-time feedback to an operator on whether or not perforation has occurred based on the electrical signal from shock sensor 105.

Figure 4:
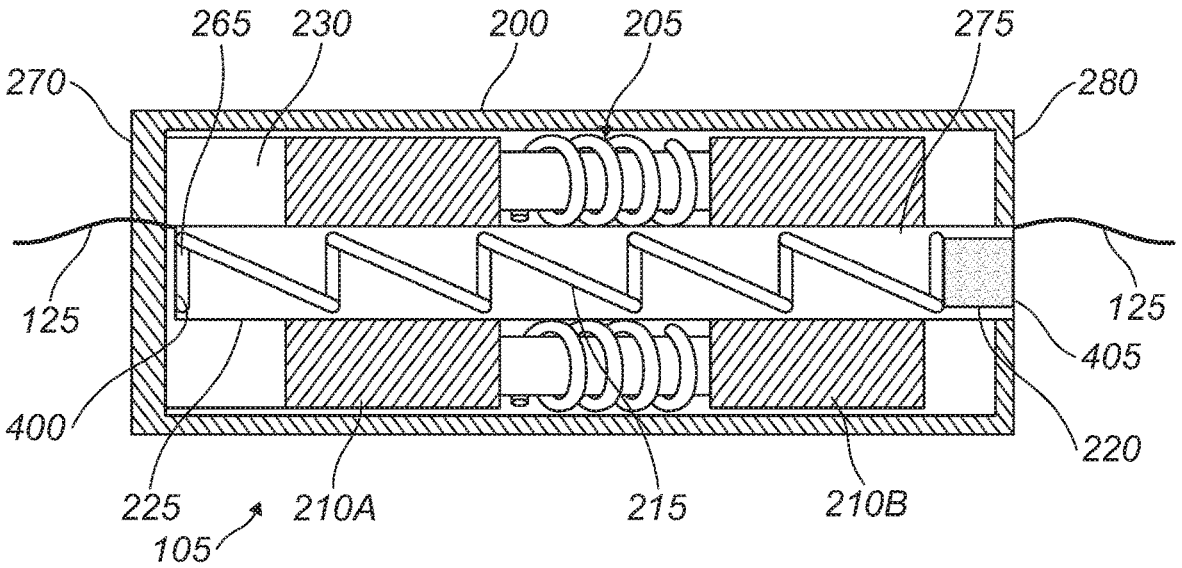
FIG. 4 illustrates an example of a shock sensor prior to a perforation.
Figure 5:
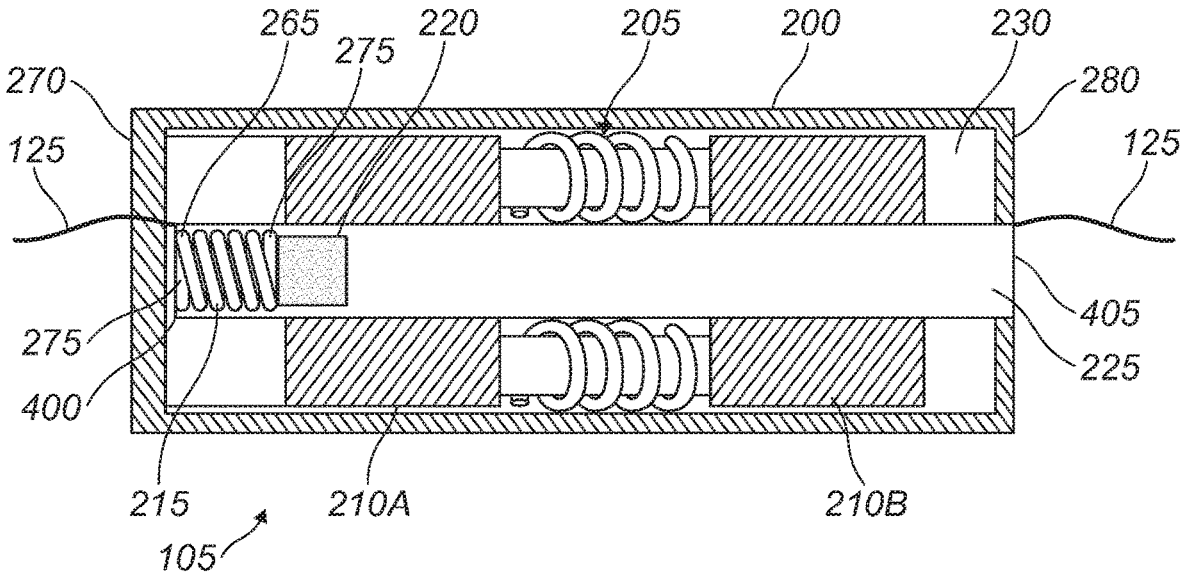
FIG. 5 illustrates an example of a shock sensor after perforation.

FIGS. 4-5 illustrate another example of shock sensor 105. FIG. 4 illustrates shock sensor 105 prior to a perforation operation. FIG. 5 illustrates shock sensor 105 after perforation has occurred. Concerning the present examples, central bore 225 may be contained or "closed-off" between first end 270 and second end 280 of housing 200. Further, spring 215 and metallic member 220 may be disposed and operate within central bore 225. First end 265 of spring 215 may be secured to a first end 400 of central bore 225 and second end 275 of spring 215 may constrain metallic member 220 against a second end 405 of central bore 225 when in a relaxed position. In these examples, metallic member 220 may be in the shape of a ball, cylinder, and/or combinations thereof. As illustrated, coil 205 may be disposed between magnets 210A, 210B, however, coil 205 and magnets 210A, 210B may be disposed around an external surface of central bore 225 within internal cavity 230. In these examples, coil 205 and magnets 210A, 210B may be cylindrical with an inner diameter and an outer diameter. To prevent interference in operation of shock sensor 105, conveyance 125 may be disposed about an external surface of central bore 225 between central bore 225 and other components of shock sensor 105. With respect to the present examples, shock sensor 105 may function and operate similarly to previous examples.

Figure 6:
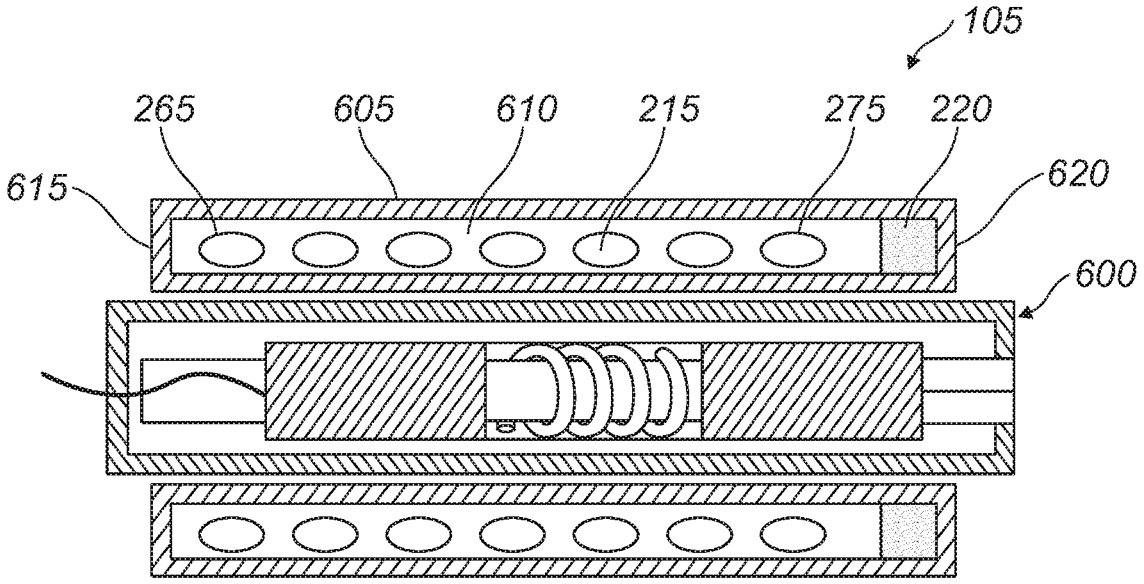
FIG. 6 illustrates an example of a shock sensor incorporated into a casing collar locator.

FIG. 6 illustrates another example of shock sensor 105 prior to a perforation operation. In this particular example, shock sensor 105 may include a casing collar locator (CCL) tool 600 and a sleeve 605. Casing collar locator tool 600 may be any suitable CCL known to those of ordinary skill in the art used for depth measurement of a cased wellbore 160 (i.e., referring to FIG. 1). As illustrated, sleeve 605 may be disposed around CCL tool 600. Sleeve 605 may be disposed around CCL tool 600 through the use of any suitable mechanisms, including, but not limited to, the use of suitable fasteners, threading, adhesives, welding, and/or combinations thereof. Without limitation, suitable fasteners may include nuts and bolts, washers, screws, pins, sockets, rods and studs, hinges and/or any combination thereof. Sleeve 605 may be any suitable size, height, and/or shape. Without limitation, a suitable shape may include, but is not limited to, cross-sectional shapes that are circular, elliptical, triangular, rectangular, square, hexagonal, and/or combinations thereof. In example, sleeve 605 may have a circular cross-section with an inner diameter and an outer diameter to form a central bore that traverses the length of housing sleeve 605. In example, CCL tool 600 may be disposed within the central bore of sleeve 605. Without limitation, sleeve 605 may include any suitable material such as metals, nonmetals, polymers, ceramics, and/or any combination thereof. Sleeve 605 may include an internal chamber 610, wherein the internal chamber 610 may be disposed between the inner diameter and the outer diameter of sleeve 605. In example, spring 215 and metallic member 220 may be disposed within internal chamber 610. First end 265 of spring 215 may be secured to a first end 615 of sleeve 605 and second end 275 of spring 215 may constrain metallic member 220 against a second end 620 of sleeve 605 when in a relaxed position. In these examples, metallic member 220 may be in the shape of a ring. With respect to the present example, shock sensor 105 may function and operate similarly to previous examples.

This method and system may include any of the various features of the compositions, methods, and system disclosed herein, including one or more of the following statements.

Statement 1. A shock sensor, comprising: a housing, wherein the housing is cylindrical, wherein the housing comprises: a first end; a second end; a central bore that traverses a length of the housing; and an internal cavity; a coil, wherein the coil is disposed about the central bore; at least two magnets, wherein the at least two magnets are disposed about the central bore; a spring, wherein the spring is a compression spring, wherein the spring is disposed within the housing, wherein the spring comprises a first end and a second end; and a metallic member, wherein the metallic member is disposed at the second end of the spring.

Statement 2. The shock sensor of statement 1, wherein the first end of the spring is coupled to the first end of the housing, wherein the spring constrains the metallic member against the second end of the housing.

Statement 3. The shock sensor of statement 1 or 2, wherein the spring is disposed around the at least two magnets and the coil.

Statement 4. The shock sensor of any one of the previous statements, wherein the metallic member is a moveable element within the housing, wherein the metallic member comprises an inner diameter and an outer diameter that forms a ring, wherein the inner diameter is greater than the at least two magnets and the coil.

Statement 5. The shock sensor of any one of the previous statements, wherein the coil is disposed between the at least two magnets, wherein ends of the coil abut ends of the at least two magnets that have the same polarity.

Statement 6. The shock sensor of any one of the previous statements, wherein the central bore is contained within the housing, wherein the spring and the metallic member are disposed within the central bore.

Statement 7. The shock sensor of statement 6, wherein the first end of the spring is coupled to a first end of the central bore, wherein the spring constrains the metallic member against a second end of the central bore.

Statement 8. The shock sensor of statement 6, wherein the metallic member is selected from a group consisting of a ball, cylinder, and combinations thereof.

Statement 9. The shock sensor of statement 6, wherein the at least two magnets and the coil are disposed around an external surface of the central bore within the internal cavity.

Statement 10. The shock sensor of any one of the previous statements, further comprising a sleeve and a casing collar locator tool, wherein the sleeve is disposed around the casing collar locator tool, wherein the sleeve is hollow.

Statement 11. The shock sensor of statement 10, wherein the spring and the metallic member are disposed within the sleeve.

Statement 12. The shock sensor of statement 11, wherein the first end of the spring is coupled to a first end of the sleeve, wherein the spring constrains the metallic member against a second end of the sleeve.

Statement 13. A method of validating perforation in real-time, comprising: disposing a shock sensor downhole into a wellbore on a conveyance, wherein a downhole perforating system is disposed on the conveyance; actuating the downhole perforating system to perforate the wellbore; and measuring a change in a magnetic field with a shock sensor, wherein the shock sensor comprises: a housing, wherein the housing is cylindrical, wherein the housing comprises: a first end; a second end; a central bore that traverses a length of the housing; and an internal cavity; a coil, wherein the coil is disposed about the central bore; at least two magnets, wherein the at least two magnets are disposed about the central bore; a spring, wherein the spring is a compression spring, wherein the spring is disposed within the housing, wherein the spring comprises a first end and a second end; and a metallic member, wherein the metallic member is disposed at the second end of the spring.

Statement 14. The method of statement 13, wherein actuating the downhole perforating system comprises of producing a shock wave.

Statement 15. The method of statement 13 or 14, further comprising of displacing the metallic member axially along the housing of the shock sensor.

Statement 16. The method of statement 15, further comprising of producing an electrical signal from the change in the magnetic field as the metallic member displaces.

Statement 17. The method of statement 16, further comprising of transmitting the electrical signal uphole to be processed by an information handling system.

Statement 18. A downhole system configured to validate perforation in real-time, comprising: a conveyance; a shock sensor, wherein the shock sensor is disposed on the conveyance in a wellbore, wherein the shock sensor comprises: a housing, wherein the housing is cylindrical, wherein the housing comprises: a first end; a second end; a central bore that traverses a length of the housing; and an internal cavity; a coil, wherein the coil is disposed about the central bore; at least two magnets, wherein the at least two magnets are disposed about the central bore; a spring, wherein the spring is a compression spring, wherein the spring is disposed within the housing, wherein the spring comprises a first end and a second end; and a metallic member, wherein the metallic member is disposed at the second end of the spring; a downhole perforating system, wherein the downhole perforating system is disposed on the conveyance further downhole in relation to the shock sensor; and an information handling system, wherein the information handling system is disposed at a surface of the wellbore, wherein the information handling system is configured to validate perforation in real-time by processing an electrical signal produced by the shock sensor.

Statement 19. The downhole system of statement 18, wherein the first end of the spring is coupled to the first end of the housing, wherein the spring constrains the metallic member against the second end of the housing, wherein the metallic member is configured to compress the spring and displace axially along the housing in response to interaction with a shock wave.

Statement 20. The downhole system of statement 19, wherein the coil is disposed between the at least two magnets, wherein ends of the coil abut ends of the at least two magnets that have the same polarity, wherein the coil measures a change in a magnetic field as the metallic member displaces along the housing and produces the electrical signal.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A shock sensor, comprising:

a housing, wherein the housing is cylindrical, wherein the housing comprises:

a first end;

a second end;

a central bore that traverses a length of the housing; and an internal cavity;

a coil, wherein the coil is disposed about the central bore;

at least two magnets, wherein the at least two magnets are disposed about the central bore;

a spring, wherein the spring is a compression spring, wherein the spring is disposed within the housing, wherein the spring comprises a first end and a second end; and a metallic member, wherein the metallic member is disposed at the second end of the spring;

wherein the first end of the spring is coupled to the first end of the housing, and wherein the spring constrains the metallic member against the second end of the housing.

2. The shock sensor of claim 1, wherein the spring is disposed around the at least two magnets and the coil.

3. The shock sensor of claim 1, wherein the metallic member is a moveable element the housing, wherein the metallic member comprises an inner diameter and an outer diameter that forms a ring, and wherein the inner diameter is greater than the at least two magnets and the coil.

4. The shock sensor of claim 1, wherein the coil is disposed between the at least two magnets, wherein ends of the coil abut ends of the at least two magnets that have the same polarity.

5. The shock sensor of claim 1, wherein the central bore is contained within the housing, wherein the spring and the metallic member are disposed within the central bore.

6. A shock sensor, comprising:

a housing, wherein the housing is cylindrical, wherein the housing comprises:

a first end;

a second end;

a central bore that traverses a length of the housing; and an internal cavity;

a coil, wherein the coil is disposed about the central bore;

at least two magnets, wherein the at least two magnets are disposed about the central bore:

a spring, wherein the spring is a compression spring, wherein the spring is disposed within the housing, wherein the spring comprises a first end and a second end;

a metallic member, wherein the metallic member is disposed at the second end of the spring; and wherein the central bore is contained within the housing, wherein the spring and the metallic member are disposed within the central bore; wherein the first end of the spring is coupled to a first end of the central bore, and wherein the spring constrains the metallic member against a second end of the central bore.

7. The shock sensor of claim 5, wherein the metallic member is selected from a group consisting of a ball, cylinder, and combinations thereof.

8. The shock sensor of claim 5, wherein the at least two magnets and the coil are disposed around an external surface of the central bore within the internal cavity.

9. A shock sensor, comprising:

a housing, wherein the housing is cylindrical, wherein the housing comprises:

a first end;

a second end;

a central bore that traverses a length of the housing; and an internal cavity;

a coil, wherein the coil is disposed about the central bore;

at least two magnets, wherein the at least two magnets are disposed about the central bore:

a spring, wherein the spring is a compression spring, wherein the spring is disposed within the housing, wherein the spring comprises a first end and a second end;

a metallic member, wherein the metallic member is disposed at the second end of the spring;

a sleeve; and a casing collar locator tool, wherein the sleeve is disposed around the casing collar locator tool, wherein the sleeve is hollow.

10. The shock sensor of claim 9, wherein the spring and the metallic member are disposed within the sleeve.

11. The shock sensor of claim 10, wherein the first end of the spring is coupled to a first end of the sleeve, wherein the spring constrains the metallic member against a second end of the sleeve.

12. A method of validating perforation in real-time, comprising:

disposing a shock sensor downhole into a wellbore on a conveyance, wherein a downhole perforating system is disposed on the conveyance;

actuating the downhole perforating system to perforate the wellbore; and measuring a change in a magnetic field with the shock sensor, wherein the shock sensor comprises:

a housing, wherein the housing is cylindrical, wherein the housing comprises:

a first end;

a second end;

a central bore that traverses a length of the housing; and an internal cavity;

a coil, wherein the coil is disposed about the central bore;

at least two magnets, wherein the at least two magnets are disposed about the central bore;

a spring, wherein the spring is a compression spring, wherein the spring is disposed within the housing, wherein the spring comprises a first end and a second end; and a metallic member, wherein the metallic member is disposed at the second end of the spring;

wherein the first end of the spring is coupled to the first end of the housing, and wherein the spring constrains the metallic member against the second end of the housing.

13. The method of claim 12, wherein actuating the downhole perforating system comprises of producing a shock wave.

14. The method of claim 12, further comprising of displacing the metallic member axially along the housing of the shock sensor.

15. The method of claim 14, further comprising of producing an electrical signal from the change in the magnetic field as the metallic member displaces.

16. The method of claim 15, further comprising of transmitting the electrical signal uphole to be processed by an information handling system.

17. A downhole system configured to validate perforation in real-time, comprising:

a conveyance;

a shock sensor, wherein the shock sensor is disposed on the conveyance in a wellbore, wherein the shock sensor comprises:

a housing, wherein the housing is cylindrical, wherein the housing comprises:

a first end;

a second end;

a central bore that traverses a length of the housing; and an internal cavity;

a coil, wherein the coil is disposed about the central bore;

at least two magnets, wherein the at least two magnets are disposed about the central bore;

a spring, wherein the spring is a compression spring, wherein the spring is disposed within the housing, wherein the spring comprises a first end and a second end; and a metallic member, wherein the metallic member is disposed at the second end of the spring;

wherein the first end of the spring is coupled to the first end of the housing, wherein the spring constrains the metallic member against the second end of the housing, wherein the metallic member is configured to compress the spring and displace axially along the housing in response to interaction with a shock wave;

a downhole perforating system, wherein the downhole perforating system is disposed on the conveyance further downhole in relation to the shock sensor; and an information handling system, wherein the information handling system is disposed at a surface of the wellbore, wherein the information handling system is configured to validate perforation in real-time by processing an electrical signal produced by the shock sensor.

18. The downhole system of claim 17, wherein the coil is disposed between the at least two magnets, wherein ends of the coil abut ends of the at least two magnets that have the same polarity, wherein the coil measures a change in a magnetic field as the metallic member displaces along the housing and produces the electrical signal.

19. A shock sensor, comprising:

a housing, wherein the housing is cylindrical, wherein the housing comprises:

a first end;

a second end;

a central bore that traverses a length of the housing; and an internal cavity;

a coil, wherein the coil is disposed about the central bore;

at least two magnets, wherein the at least two magnets are disposed about the central bore;

a spring, wherein the spring is a compression spring, wherein the spring is disposed within the housing, wherein the spring comprises a first end and a second end;

a metallic member, wherein the metallic member is disposed at the second end of the spring;

wherein the spring is disposed around the at least two magnets and the coil.

20. A shock sensor, comprising:

a housing, wherein the housing is cylindrical, wherein the housing comprises:

a first end;

a second end;

a central bore that traverses a length of the housing; and an internal cavity;

a coil, wherein the coil is disposed about the central bore;

at least two magnets, wherein the at least two magnets are disposed about the central bore;

a spring, wherein the spring is a compression spring, wherein the spring is disposed within the housing, wherein the spring comprises a first end and a second end;

a metallic member, wherein the metallic member is disposed at the second end of the spring; and wherein the metallic member is a moveable element within the housing, wherein the metallic member comprises an inner diameter and an outer diameter that forms a ring, and wherein the inner diameter is greater than the at least two magnets and the coil.

* * * * *